US007213584B2

(12) United States Patent
Ohhashi et al.

(10) Patent No.: US 7,213,584 B2
(45) Date of Patent: May 8, 2007

(54) FUEL SUPPLY APPARATUS AND CONTROL METHOD FOR INTERNAL COMBUSTION ENGINE

(75) Inventors: Hironori Ohhashi, Isesaki (JP); Hiroshi Okada, Isesaki (JP); Masato Kumagai, Isesaki (JP)

(73) Assignee: Hitachi, Ltd., Tokyo (JP)

( * ) Notice: Subject to any disclaimer, the term of this patent is extended or adjusted under 35 U.S.C. 154(b) by 196 days.

(21) Appl. No.: 11/019,197

(22) Filed: Dec. 23, 2004

(65) Prior Publication Data

US 2005/0139197 A1 Jun. 30, 2005

(30) Foreign Application Priority Data

Dec. 26, 2003 (JP) ..... 2003-432995

(51) Int. Cl.
*F02M 33/02* (2006.01)

(52) U.S. Cl. ..... 123/519; 123/520

(58) Field of Classification Search ..... 123/509, 123/516, 518, 519, 520
See application file for complete search history.

(56) References Cited

U.S. PATENT DOCUMENTS 4,852,761 A * 8/1989 Turner et al. ..... 220/746
4,919,103 A * 4/1990 Ishiguro et al. ..... 123/514
5,454,697 A * 10/1995 Nakanishi ..... 417/423.3
6,182,693 B1 * 2/2001 Stack et al. ..... 137/565.17
6,273,070 B1 * 8/2001 Arnal et al. ..... 123/519
6,302,144 B1 * 10/2001 Graham et al. ..... 137/565.17
6,354,280 B1 * 3/2002 Itakura et al. ..... 123/519
6,367,458 B1 * 4/2002 Furusho et al. ..... 123/519
6,935,317 B2 * 8/2005 Wiesenberger et al. ..... 123/519
2004/0112341 A1 * 6/2004 Mashimo et al. ..... 123/520
2004/0149271 A1 * 8/2004 Wiesenberger et al. ..... 123/509

FOREIGN PATENT DOCUMENTS

JP 7-91330 A 4/1995

* cited by examiner

*Primary Examiner*—Thomas Moulis
(74) *Attorney, Agent, or Firm*—Foley & Lardner LLP

(57) ABSTRACT

A canister, a cut valve which closes a fresh air intake of the canister, and a pressure sensor which detects a pressure in a fuel vapor path shut off by closing a purge control valve and the cut valve are disposed at the inside of a fuel tank, and a fuel supply control unit which controls the cut valve and the purge control valve, and which carries out a leak diagnosis on the basis of a detected result of the pressure sensor is disposed at the inside of the fuel tank.

15 Claims, 3 Drawing Sheets

FUEL SUPPLY APPARATUS AND CONTROL METHOD FOR INTERNAL COMBUSTION ENGINE

BACKGROUND OF THE INVENTION

1. Field of the Invention

The present invention relates to a fuel supply apparatus supplying fuel to an internal combustion engine and a method for controlling the fuel supply apparatus.

2. Description of the Related Art

Japanese Unexamined Patent Publication No.07-091330 discloses a fuel vapor purge system which traps fuel vapor generated inside a fuel tank in a canister, and which purges the fuel vapor trapped in the canister, into an intake passage via a purge passage at which a purge control valve is provided.

Further, the above Publication discloses a method for diagnosing whether there is any leak at the above-described fuel vapor purge system.

In the leak diagnosis, a drain cut valve is provided at a fresh air intake of the canister, and a discharge opening of an air pump is connected along the purge passage at the downstream of the purge control valve.

Here, due to air being supplied to the purge passage by the air pump in a state in which the drain cut valve and the purge control valve are closed, a diagnostic zone including the purge passage, the canister, and the fuel tank is pressurized.

Then, it is diagnosed whether there is any leak on the basis of a change of pressure in the diagnostic zone accompanying the pressurization.

By the way, in addition to providing the fuel vapor purge system, when a drain cut valve, an air pump, a pressure sensor, or the like which are for a leak diagnosis are provided thereat, there has been the problem that a large number of controlled system parts and sensors in the fuel supply apparatus are used, and the wirings with a control unit are made longer and complicated.

SUMMARY OF THE INVENTION

Therefore, an object of the present invention is to configure wirings between a control unit and controlled system parts/sensors so as to be short and simple in a fuel supply apparatus.

In order to achieve the above described object, in the present invention, devices and a control unit are disposed in a fuel tank, and the devices in the fuel tank are controlled by the control unit disposed in the fuel tank.

The other objects and features of this invention will become understood from the following description with reference to the accompanying drawings.

PREFERRED EMBODIMENT

Figure 1:
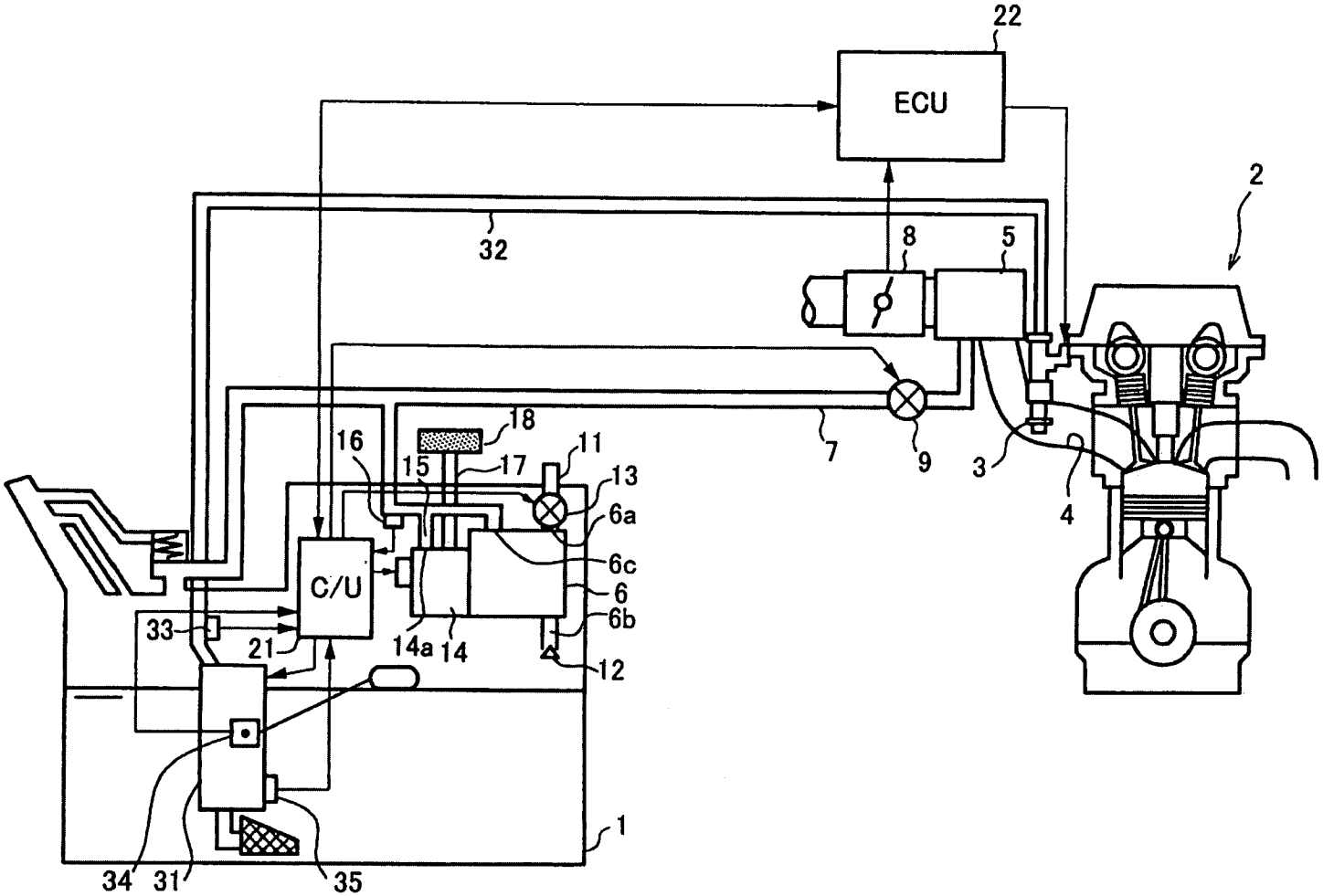
FIG. 1 is a block diagram of a fuel supply apparatus in an embodiment.

FIG. 1 shows a fuel supply apparatus having a fuel vapor purge system for an internal combustion engine on a vehicle.

A fuel pump 31 is installed in a fuel tank 1.

Fuel discharged from the fuel pump 31 is supplied to a fuel injection valve 3 via a fuel piping 32.

A fuel pressure sensor 33 detecting a fuel pressure in the fuel piping 32 is provided at a portion, which is positioned in the fuel tank 1, of the fuel piping 32.

A fuel supply control unit 21 installed inside the fuel tank 1 controls to drive the fuel pump 31 in accordance with a fuel pressure detected at the fuel pressure sensor 33.

Further, detection signals of a fuel level sensor 34 and a fuel temperature sensor 35 are inputted to the fuel supply control unit 21.

The fuel injection valve 3 is provided at an intake port 4 of each cylinder of an internal combustion engine 2, and is driven to open by an injection pulse signal outputted from an engine control unit 22.

Note that the fuel supply control unit 21 and the engine control unit 22 are configured so as to be capable of intercommunication via a communication line.

Purge air including fuel vapor which has been purged from a canister 6 is supplied to an intake air collector 5 at the upstream side of the fuel injection valve 3 via a purge passage 7.

A throttle valve 8 is installed at the upstream side of the intake air collector 5.

An intake air flow of the internal combustion engine 2 is adjusted in accordance with an opening of the throttle valve 8.

A purge control valve 9 is installed along the way of the purge passage 7.

A purge air amount supplied to the internal combustion engine 2 via the purge passage 7 is controlled in accordance with an opening of the purge control valve 9.

The canister 6 is one in which adsorbent such as activated charcoal or the like is filled in a container, and is installed at the upper portion in the fuel tank 1.

A fresh air intake pipe 11 is connected to a fresh air intake **6*a* provided at the canister 6**.

The fresh air intake pipe 11 is installed so as to pass through the wall of the fuel tank 1 and to be extended up to the exterior of the fuel tank 1, and is released in the atmosphere outside of the fuel tank 1.

Further, a fuel vapor inlet **6*b* released in the fuel tank 1 via a cut valve 12 is provided at the canister 6**.

The cut valve 12 is a mechanical valve which usually opens and closes at the time of being sunk in liquid.

Fuel vapor generated inside the fuel tank 1 is absorbed into the adsorbent in the canister 6 via the fuel vapor inlet **6*b* when the cut valve 12** is opened.

On the other hand, the purge passage 7 is connected to a fuel vapor outlet **6*c* of the canister 6**.

Here, the purge control valve 9 is controlled by the fuel supply control unit 21.

The fuel supply control unit 21 controls to open the purge control valve 9 when a purge permission condition is established during an operation of the internal combustion engine 2.

When the purge control valve 9 opens, an intake negative pressure of the internal combustion engine 2 acts on the canister 6, and as a result, the fuel vapor which has been absorbed in the canister 6 is detached by the fresh air, which is introduced through the fresh air intake **6*a***.

Then, the purge gas including the detached fuel vapor is sucked in the intake air collector 5 through the purge passage 7.

Further, in the present embodiment, a function of diagnosing whether there is any leak in the fuel vapor path from the fuel tank 1 up to the purge control valve 9 is provided.

For the leak diagnosis, a drain cut valve 13 is provided at a portion, which is positioned in the fuel tank 1, of the fresh air intake pipe 11, and an air pump 14 supplying air into the purge passage 7 is installed in the fuel tank 1.

The air pump 14 is disposed in the vicinity of the canister 6 in the fuel tank 1,.

A discharge opening 14*a* of the air pump 14 and the purge passage 7 in the fuel tank 1 are connected through an air supply pipe 15.

Note that it can be configured such that air is supplied into the fuel tank 1 by the air pump 14 due to the discharge opening 1 4a of the air pump 14 being released inside the fuel tank 1.

Further, one end of a suction pipe 17 which is installed so as to pass through the wall of the fuel tank 1 and to be extended up to the exterior is connected to the suction port of the air pump 14, and the other end of the suction pipe 17 is released into the atmosphere via an air cleaner 18.

Moreover, a pressure sensor 16 detecting an internal pressure of the purge passage 7 is provided in the fuel tank 1.

The drain cut valve 13 and the air pump 14 are controlled by the fuel supply control unit 21, and a detection signal of the pressure sensor 16 is inputted to the fuel supply control unit 21.

The fuel supply control unit 21 shuts the purge control valve 9 and the drain cut valve 13 after stopping the internal combustion engine 2, and closes the fuel vapor path from the fuel tank 1 up to the purge control valve 9, and next, supplies air to the closed fuel vapor path due to the air pump 14 being started.

Here, in a case in which there is no leak in the closed fuel vapor path, a pressure detected at the pressure sensor 16 rises up to a predetermined pressure.

Accordingly, in a case in which a pressure detected at the pressure sensor 16 does not reach the predetermined pressure, generation of leak is estimated.

After the closed fuel vapor path is pressurized up to the predetermined pressure, the air pump 14 is stopped, and leak can be diagnosed on the basis of a pressure drop level and a pressure drop rate thereafter. Further, decompression is carried out due to air in the closed fuel vapor path being sucked by the air pump 14, and the pressure is reduced, and leak can be diagnosed on the basis of a change of pressure at the time of the decompression, or a pressure rise level and a pressure rise rate after stopping the decompression.

Figure 2:
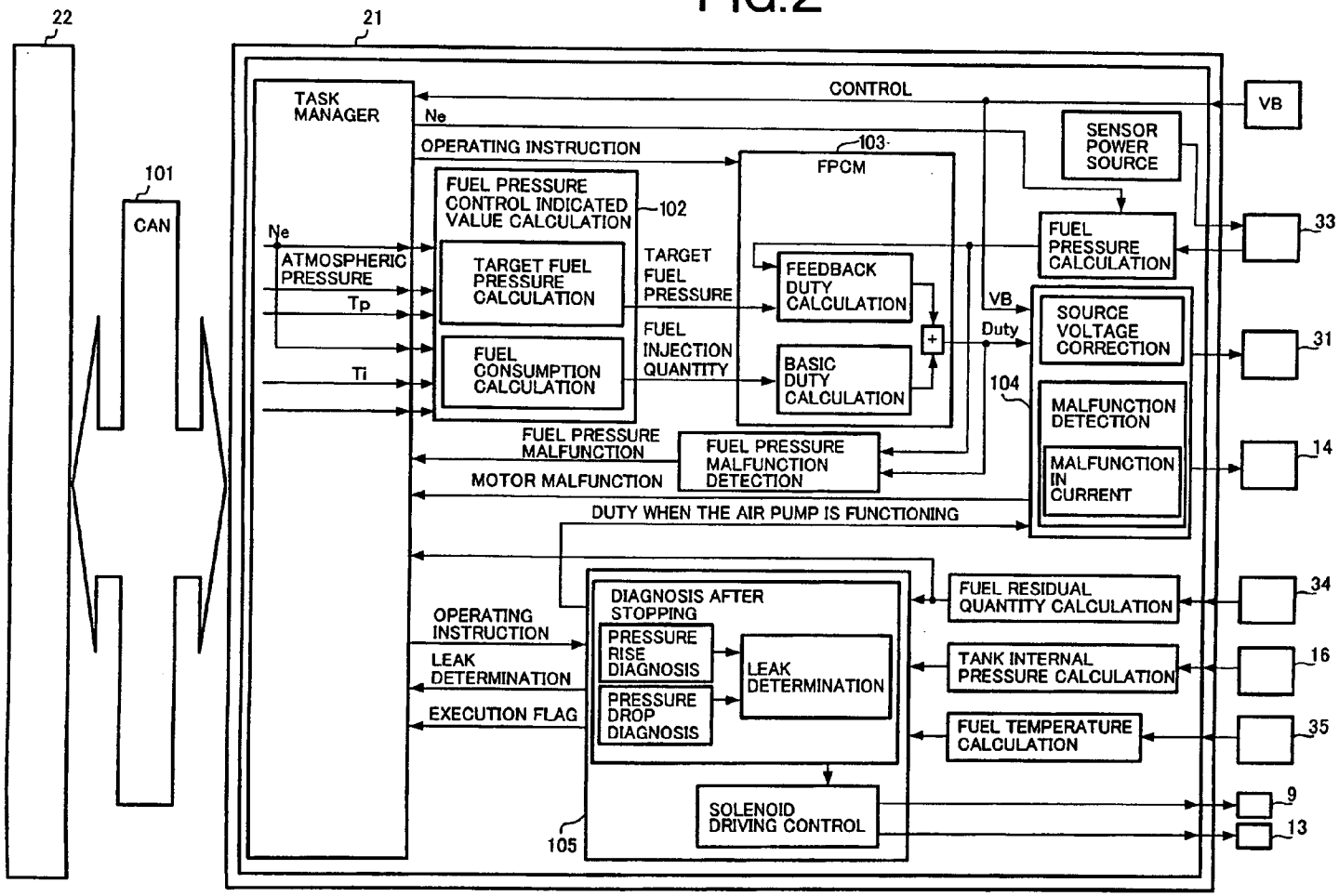
FIG. 2 is a functional block diagram of a fuel supply control unit in the embodiment.

Here, the control function of the fuel supply control unit 21 will be described in accordance with the functional block diagram in FIG. 2.

The fuel supply control unit 21 and the engine control unit 22 are configured so as to be capable of intercommunication via a network 101.

The engine control unit 22 transmits information on an engine rotational speed Ne, an atmospheric pressure, a basic fuel injection quantity Tp, a fuel injection quantity Ti by a fuel injection valve, a number of injection cylinders, or the like with respect to the fuel supply control unit 21.

On the other hand, the fuel supply control unit 21 transmits information on a pressure in the fuel tank, a result of malfunction detection for a pump current, a fuel level, or the like with respect to the engine control unit 22.

At a fuel pressure control indicated value operation part 102 of the fuel supply control unit 21, a target fuel pressure and a fuel consumption are calculated on the basis of the information on an engine rotational speed Ne, an atmospheric pressure, a basic fuel injection quantity Tp, a fuel injection quantity Ti, a number of injection cylinders, or the like.

At a fuel pump control unit (FPCM) 103, a feedback duty is calculated on the basis of a deviation between a fuel pressure detected at the fuel pressure sensor 33 and the target fuel pressure, and a basic duty is calculated on the basis of the fuel consumption.

Then, due to the sum of the feedback duty and the basic duty being outputted to a motor driving circuit 104, the fuel pump 31 is driven.

Further, a function of detecting malfunction in electric current in the fuel pump 31 is provided at the motor driving circuit 104, and when malfunction is detected, a signal denoting that the electric current in the fuel pump 31 is abnormal is transmitted to the engine control unit 22.

Further, when an operating instruction for a leak diagnosis is outputted from the engine control unit 22 to the fuel supply control unit 21, a purge control unit 105 of the fuel supply control unit 21 controls the air pump 14, the purge control valve 9, and the cut valve 13, and carries out a leak diagnosis on the basis of detection signals of the pressure sensor 16 and the fuel temperature sensor 35. Then, the result of the leak diagnosis is outputted to the engine control unit 22.

Moreover, the fuel supply control unit 21 calculates a fuel level (residual quantity) on the basis of a detection signal of the fuel level sensor 34, and outputs the signal of the fuel level to the engine control unit 22.

In accordance with the above-described embodiment, the canister 6 configuring the fuel vapor purge system, and the drain cut valve 13, the air pump 14, and the pressure sensor 16 which are for a leak diagnosis are disposed in the fuel tank 1, and the air pump 14 is disposed in the vicinity of the canister 6.

Therefore, the overall length of the piping configuring the fuel vapor purge system can be shortened.

Further, because the coupling portions between the canister 6 and respective pipings and the coupling portions between the air supply path and the fuel vapor path through the air pump 14 are disposed in the space in the fuel tank 1, even in a case in which a leak is brought about at the coupling portion, fuel vapor leaks in the fuel tank 1, and leaking of fuel vapor into the atmosphere can be avoided.

Moreover, because the drain cut valve 13, the air pump 14 and the pressure sensor 16, and the fuel supply control unit 21 are arranged in the vicinity, handling of a harness is simplified.

Further, provided that it is configured such that the both control units 21 and 22 have information in common by communication between the fuel supply control unit 21 and the engine control unit 22, the signal lines between the both control units 21 and 22 can be simplified.

Moreover, the fuel supply control unit 21, the air pump 14, and the canister 6 disposed in the fuel tank 1 can be integrated, and in accordance therewith, the spatial efficiency can be improved.

Figure 3:
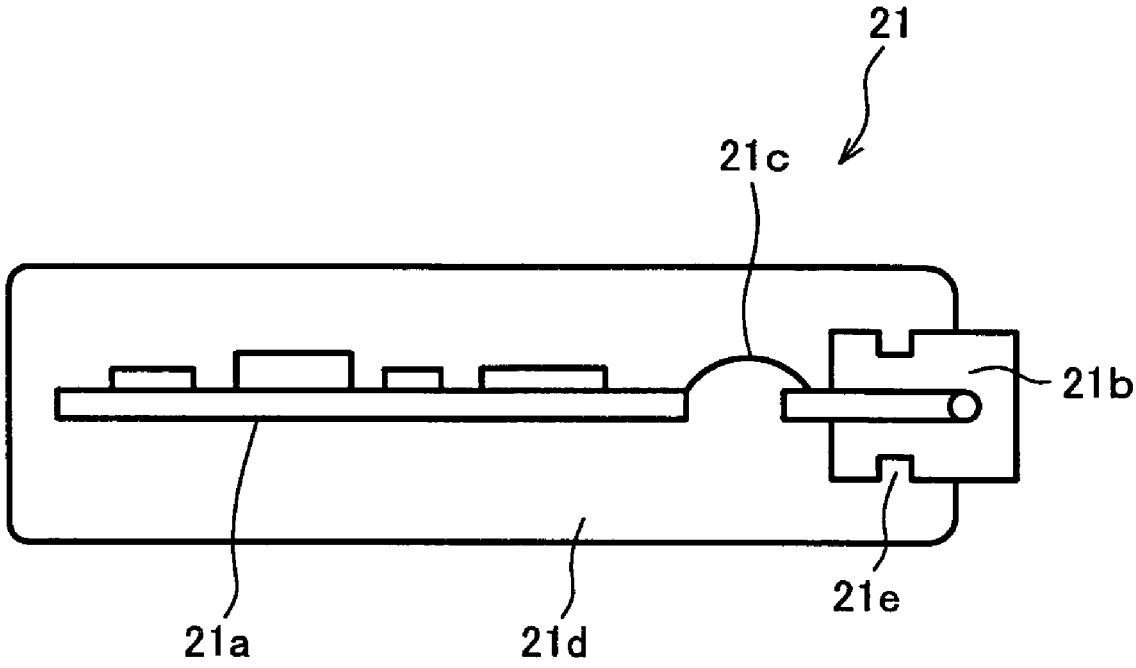
FIG. 3 is a sectional view of the fuel supply control unit in the embodiment.

The fuel supply control unit 21 is configured as shown in FIG. 3, which can prevent fuel from permeating the inside of the control unit 21.

In the fuel supply control unit 21 shown in FIG. 3, a circuit substrate 21 a and a connector 21*b* are connected with a bonding wire 21*c*, and the circuit substrate 21*a*, the bonding wire 21*c*, and the connector 21*b* are sealed in a resin mold 21*d*.

Grooves 21*e* which function as stoppers for preventing the connector being slipped off, and which are for preventing fuel from permeating are formed at the basic terminal side of the connector 21*b*.

In the above-described embodiment, it is configured such that a leak diagnosis is carried out on the basis of a detected result at the pressure sensor 16. However, the pressure sensor 16 is omitted, and a leak diagnosis may be carried out on the basis of a load on the air pump 14.

The entire contents of Japanese Patent Application NO. 2003-432995, filed Dec. 26, 2003 are incorporated herein by reference.

While only selected embodiments have been chosen to illustrate the present invention, it will be apparent to these skilled in the art from this various change and modification can be made herein without departing from the scope of the invention as defined in the appended claims.

Furthermore, the foregoing description of the embodiments according to the present invention are provided for illustration only, and not for the purpose of limiting the invention as defined by the appended claims and their equivalents.

We claim:

1. A fuel supply apparatus for an internal combustion engine comprising:

a fuel tank configured to store fuel to be supplied to the internal combustion engine;

a fuel vapor purge system configured to trap fuel vapor generated inside the fuel tank in a canister and to purge the fuel vapor trapped in the canister into an intake passage of the internal combustion engine via a purge passage on which a purge control valve is provided;

a cut valve configured to close a fresh air intake of the canister;

a pressure sensor configured to detect a pressure in a fuel vapor path that is shut off by closing the purge control valve and the cut valve;

an air pump configured to change a pressure in the fuel vapor path; and a control unit configured to output control signals to the cut valve, the purge control valve, and the air pump, to thereby diagnose whether or not there is any leak in the fuel vapor path based on a pressure calculated by inputting therein a detection signal of the pressure sensor, wherein the canister, the cut valve, the purge control valve, the pressure sensor, the air pump and the control unit are arranged within the fuel tank, and wherein one of two ports provided for the air pump is released toward the atmosphere outside the fuel tank, while permitting the other of the two ports to be released in the fuel vapor path within the fuel tank.

2. A fuel supply apparatus for an internal combustion engine according to claim 1, wherein the control unit is connected via a communication line to an engine control unit which controls the internal combustion engine.

3. A fuel supply apparatus for an internal combustion engine according to claim 1, wherein a fuel temperature sensor which detects a fuel temperature in the fuel tank is further disposed in the fuel tank, and wherein the control unit calculates a fuel temperature by inputting therein a detection signal of the fuel temperature sensor, and diagnoses whether or not there is any leak in the fuel vapor path on the basis of the pressure detected by the pressure sensor and the fuel temperature detected by the fuel temperature sensor.

4. A fuel supply apparatus for an internal combustion engine according to claim 1, wherein the air pump is connected to a portion of the purge passage, which is disposed in the fuel tank.

5. A fuel supply apparatus for an internal combustion engine according to claim 1, wherein the air pump carries air with respect to the inside of the fuel tank.

6. A fuel supply apparatus for an internal combustion engine according to claim 1, wherein the canister includes an intake for fuel vapor, and another cut valve is provided at the intake for fuel vapor and closes the intake for fuel vapor when the intake for fuel vapor is sunk in fuel.

7. A fuel supply apparatus for an internal combustion engine according to claim 1, wherein a fuel pump is further disposed in the fuel tank, and wherein the control unit diagnoses whether or not there is any leak in the fuel vapor path, and calculates a target fuel pressure, and outputs a driving signal to the fuel pump on the basis of the target fuel pressure.

8. A fuel supply apparatus for an internal combustion engine according to claim 7, wherein a fuel pressure sensor which detects a pressure of fuel supplied from the fuel pump is further disposed in the fuel tank, and wherein the control unit inputs a detection signal of the fuel pressure sensor to thereby calculate a pressure of fuel on the basis of the detection signal of the fuel pressure sensor, and calculates a deviation between the target fuel pressure and the pressure of fuel detected at the fuel pressure sensor to thereby provide feedback control to a driving signal of the fuel pump on the basis of the deviation.

9. A fuel supply apparatus for an internal combustion engine according to claim 7, wherein the control unit detects an electric current of the fuel pump, and outputs a malfunction detection signal when the electric current of the fuel pump is abnormal.

10. A fuel supply apparatus for an internal combustion engine according to claim 1, wherein a fuel level sensor which detects a level of fuel in the fuel tank is further disposed in the fuel tank, and wherein the control unit diagnoses whether or not there is any leak in the fuel vapor path, and calculates a level of fuel in the fuel tank by inputting a detection signal of the fuel level sensor, and outputs a signal denoting the fuel level.

11. A fuel supply apparatus for an internal combustion engine according to claim 1, wherein the control unit is formed so as to seal a circuit substrate in a resin mold.

12. A method for controlling a fuel supply apparatus for an internal combustion engine provided with a fuel vapor purge system configured to trap fuel vapor generated inside a fuel tank in a canister, and to purge the fuel vapor trapped in the canister into an intake passage of the internal combustion engine via a purge passage on which a purge control valve is provided, wherein the method comprises the steps of:

disposing the canister, a cut valve configured to close a fresh air intake of the canister, a pressure sensor configured to detect a pressure in a fuel vapor path that is shut off by closing the purge control valve and the cut valve, and an air pump configured to change a pressure in the fuel vapor path at the inside of the fuel tank; and releasing one of two ports of the air pump toward the atmosphere outside the fuel tank while releasing the other of the two ports in the fuel vapor path within the fuel tank;

controlling the purge control valve, the cut valve, and the air pump by a control unit disposed inside the fuel tank;

calculating a pressure on the basis of a detection signal of the pressure sensor by the control unit; and diagnosing whether or not there is any leak in the fuel vapor path on the basis of the pressure in the fuel vapor path by the control unit.

13. A method for controlling a fuel supply apparatus for an internal combustion engine according to claim 12, further comprising the following steps of:

disposing a fuel temperature sensor which detects a fuel temperature in the fuel tank at the inside of the fuel tank; and calculating a fuel temperature from the fuel temperature sensor by the control unit; and wherein the step of diagnosing whether or not there is any leak comprises diagnosing whether or not there is any leak in the fuel vapor path on the basis of the pressure in the fuel vapor path and the a-fuel temperature by the control unit.

14. A method for controlling a fuel supply apparatus for an internal combustion engine according to claim 12, further comprising the following steps of:

disposing a fuel pump in the fuel tank;

calculating a target fuel pressure by the control unit; and controlling the fuel pump on the basis of the target fuel pressure by the control unit.

15. A method for controlling a fuel supply apparatus for an internal combustion engine according to claim 12, further comprising the following steps of:

disposing a fuel level sensor which detects a level of fuel in the fuel tank at the inside of the fuel tank;

calculating a level of fuel in the fuel tank on the basis of a detection signal of the fuel level sensor by the control unit; and outputting a signal denoting the fuel level by the control unit.

* * * * *